US012448243B2

(12) United States Patent
Masunaga

(10) Patent No.: US 12,448,243 B2
(45) Date of Patent: Oct. 21, 2025

(54) DISTANCE DETECTOR, SHEET FEEDER, AND IMAGE FORMING APPARATUS

(71) Applicant: Suguru Masunaga, Kanagawa (JP)

(72) Inventor: Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 18/521,647

(22) Filed: Nov. 28, 2023

(65) Prior Publication Data

US 2024/0174471 A1 May 30, 2024

(30) Foreign Application Priority Data

Nov. 30, 2022 (JP) ..... 2022-192142

(51) Int. Cl.
*B65H 7/14* (2006.01)
*B65H 1/04* (2006.01)

(52) U.S. Cl.
CPC ..... *B65H 7/14* (2013.01); *B65H 1/04* (2013.01); *B65H 2405/1122* (2013.01);
(Continued)

(58) Field of Classification Search
CPC ..... B65H 1/04; B65H 7/14; B65H 2405/112; B65H 2405/1122; B65H 2405/1124; B65H 2511/11; B65H 2511/22; B65H 2511/51; B65H 2511/515; B65H 2553/41; B65H 2553/414; B65H 2553/61; B65H 2553/82
See application file for complete search history.

(56) References Cited

U.S. PATENT DOCUMENTS 11,420,841 B2 8/2022 Ebihara
2003/0025090 A1* 2/2003 Iwasaki ..... B65H 7/14 250/559.12

(Continued)

FOREIGN PATENT DOCUMENTS

JP 2004-123396 A 4/2004
JP 2007-067106 A 3/2007
JP 2022-044135 A 3/2022

OTHER PUBLICATIONS

Extended European Search Report dated May 8, 2024 issued in corresponding European Appln. No. 23212904.9.

*Primary Examiner* — Prasad V Gokhale
(74) *Attorney, Agent, or Firm* — Harness, Dickey & Pierce, P.L.C.

(57) ABSTRACT

A distance detector includes a distance-measuring sensor, a first detection surface, a second detection surface, and processing circuitry. The first detection surface is perpendicular to an optical axis of the distance-measuring sensor. The second detection surface is behind or in front of the first detection surface with respect to the distance-measuring sensor. The second detection surface has two faces inclined with respect to the optical axis of the distance-measuring sensor. The first detection surface or the second detection surface is retractable from the distance-measuring sensor. The processing circuitry determines whether the first detection surface or the second detection surface is detected by the distance-measuring sensor and causes the distance detector to detect a distance from the distance-measuring sensor to the first detection surface based on detection of the first detection surface by the distance-measuring sensor.

9 Claims, 12 Drawing Sheets

(52) U.S. Cl.
CPC ... *B65H 2405/1124* (2013.01); *B65H 2511/11* (2013.01); *B65H 2511/22* (2013.01); *B65H 2511/51* (2013.01); *B65H 2511/515* (2013.01); *B65H 2553/414* (2013.01); *B65H 2553/61* (2013.01); *B65H 2553/82* (2013.01)

(56) References Cited

U.S. PATENT DOCUMENTS

| | | | | |
|---|---|---|---|---|
| 2014/0197594 | A1* | 7/2014 | Suzuki | B65H 31/20 271/213 |
| 2017/0368849 | A1 | 12/2017 | Masunaga | |
| 2020/0262221 | A1 | 8/2020 | Yokozawa et al. | |
| 2021/0114382 | A1 | 4/2021 | Barnes et al. | |
| 2021/0155435 | A1 | 5/2021 | Masunaga | |
| 2022/0073308 | A1* | 3/2022 | Ebihara | B65H 43/00 |
| 2022/0088947 | A1 | 3/2022 | Yokozawa et al. | |
| 2022/0097986 | A1* | 3/2022 | Chong | B65H 1/266 |
| 2022/0169476 | A1 | 6/2022 | Masunaga | |

* cited by examiner

NORMAL SETTING

INCORRECT SETTING

DISTANCE DETECTOR, SHEET FEEDER, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2022-192142, filed on Nov. 30, 2022, in the Japan Patent Office, the entire disclosure of which is hereby incorporated by reference herein.

BACKGROUND

Technical Field

Embodiments of the present disclosure relate to a distance detector, a sheet feeder, and an image forming apparatus.

Related Art

A method is known that reliably detects the distance to an object to be detected and whether the object to be detected is present or absent by a distance-measuring sensor. Also, a method is known that detects whether an end fence, which contacts the rear ends of sheets in a conveyance direction in a sheet feeder including a large-capacity sheet feeding lift table, is correctly set and detects a sheet size of the sheets. In such a large-capacity sheet feeding apparatus provided with a large-capacity sheet tray (LCT), a detection sensor is disposed at a position other than the LCT such as a fence (for example, a side fence) for the purpose of detecting the sheet size, so that the sheet size can be detected in accordance with the position of the fence regardless of the elevation of the LCT.

In the above-described method in which the distance-measuring sensor detects the presence or absence of an object to be detected and the distance to the object to be detected, it is preferable that an object to be detected not be disposed to face a light emitter or laser diode (LD) of the distance-measuring sensor such that the distance-measuring sensor detects that there is no object to be detected. For this reason, a method is known in which an opening is disposed, for example, on an exterior of an apparatus. Also, a method is known in which an oblique surface and a surface having a low reflectance are disposed to face the distance-measuring sensor.

In the above-described large-capacity sheet feeding apparatus provided with the large-capacity sheet tray, an end fence is disposed at a position corresponding to the sheet size of the recording media in the conveyance direction to correctly stack the recording media such as printing paper. In the large-capacity sheet feeding apparatus, the end fence is slidable in response to the movement of the large-capacity sheet feeding lift table movable in the vertical direction. The large-capacity sheet feeding lift table includes a slit such that the large-capacity sheet feeding lift table is movable in the vertical direction. The distance-measuring sensor detects the distance to the end fence to detect the sheet size.

SUMMARY

In an embodiment of the present disclosure, a distance detector includes a distance-measuring sensor, a first detection surface, a second detection surface, and processing circuitry. The first detection surface is perpendicular to an optical axis of the distance-measuring sensor. The second detection surface is behind or in front of the first detection surface with respect to the distance-measuring sensor. The second detection surface has two faces inclined with respect to the optical axis of the distance-measuring sensor. The first detection surface or the second detection surface is retractable from the distance-measuring sensor. The processing circuitry determines whether the first detection surface or the second detection surface is detected by the distance-measuring sensor and causes the distance detector to detect a distance from the distance-measuring sensor to the first detection surface based on detection of the first detection surface by the distance-measuring sensor.

In another embodiment of the present disclosure, a sheet feeder includes a lift table, an end fence, a distance-measuring sensor, a surface, and processing circuitry. The end fence is movable to a position corresponding to a size of a recording medium in a conveyance direction, the end fence being at a position at which the end fence is installed in the sheet feeder or a position at which the end fence is retracted from the sheet feeder. The distance-measuring sensor faces a front surface of the end fence. The surface is formed by two surfaces to face a rear surface of the end fence and inclined with respect to an optical axis of the distance-measuring sensor. The processing circuitry causes the distance-measuring sensor to detect a distance between the distance-measuring sensor and the surface of the end fence to detect a sheet size of the recording medium when the end fence is installed in the sheet feeder and detect the surface of the end fence to determine whether the end fence is installed in the sheet feeder or retracted from the sheet feeder when the end fence is retracted from the sheet feeder.

In still another embodiment of the present disclosure, an image forming apparatus includes the sheet feeder.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1A:
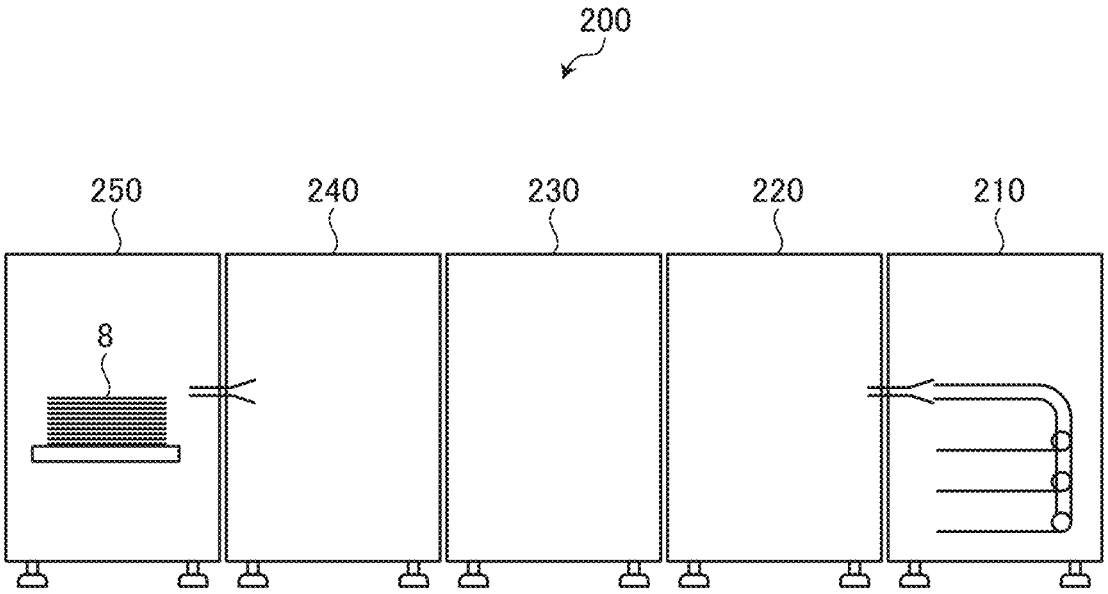
FIG. 1A is a diagram illustrating a configuration of an image forming system according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure related to a distance detector, a sheet feeder, and an image forming apparatus are described in detail below with reference to the accompanying drawings.

FIG. 1A is a diagram illustrating a configuration of an image forming system 200 according to an embodiment of the present disclosure. As illustrated in FIG. 1A, the image forming system 200 according to the present embodiment serves as an image forming apparatus and includes a sheet feeder 210, a pretreatment-liquid application device 220, an inkjet printer 230, a drier 240, and a sheet ejector 250.

A recording medium 8 that is conveyed from the sheet feeder 210 is sent to the pretreatment-liquid application device 220. The pretreatment-liquid application device 220 applies, to the recording medium 8, a pretreatment liquid for enhancement of image quality such as prevention of ink bleeding and assistance of ink permeation. The pretreatment-liquid application device 220 applies the pretreatment liquid to the front side, the back side, or both sides of the recording medium 8.

The sheet feeder 210 supplies a recording medium 8 such as a cut sheet to the pretreatment-liquid application device 220 disposed downstream from the sheet feeder 210 in a conveyance path of the recording medium 8. As described below, the pretreatment-liquid application device 220 applies the pretreatment liquid, which prevents, for example, bleeding and bleed-through of inkjet ink printed on the recording medium 8, to the recording medium 8. The pretreatment-liquid application device 220 includes a reverse path. When duplex printing is performed, the pretreatment-liquid application device 220 applies the pretreatment liquid to the front side of a recording medium 8. Then, the pretreatment-liquid application device 220 reverses the recording medium 8 and applies the pretreatment liquid to the back side of the recording medium 8.

The inkjet printer 230 discharges ink droplets to the front side of the recording medium 8, to which the pretreatment liquid has been applied by the pretreatment-liquid application device 220, to form a desired image.

The drier 240 includes a drying device and dries the image, which has been formed by the inkjet printer 230, on the front side of the recording medium 8. When printing is performed on the front and back sides of the recording medium 8, the recording medium 8 is reversed along a path on which the recording medium 8 returns from the drier 240 back to the inkjet printer 230. Then, the inkjet printer 230 discharges ink droplets to the front side, which is the back side of the recording medium 8 before the recording medium 8 is reversed, of the recording medium 8 to form a desired image. Subsequently, the image on the front side, which is the back side of the recording medium 8 before the recording medium 8 is reversed, of the recording medium 8 is dried by the drier 240. Subsequently, the recording medium 8 is ejected to the sheet ejector 250.

Figure 1B:
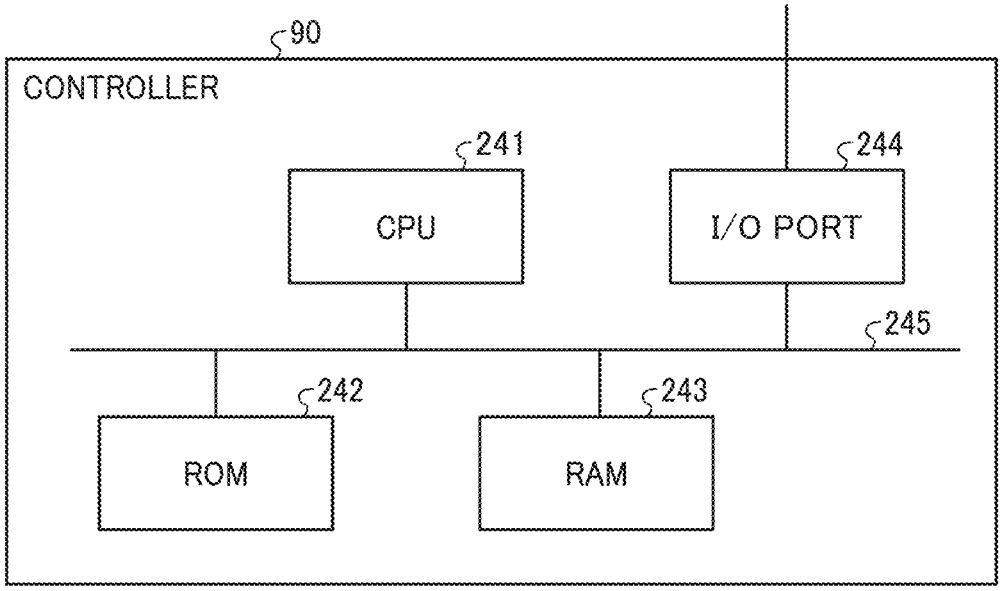
FIG. 1B is a diagram illustrating a hardware configuration of a controller of the image forming system of FIG. 1A, according to an embodiment of the present disclosure.

FIG. 1B is a diagram illustrating a hardware configuration of a controller 90 of the image forming system 200, according to an embodiment of the present disclosure.

The image forming system 200 according to the present embodiment includes the controller 90 to control the entire image forming system 200. As illustrated in FIG. 1B, the controller 90 includes a central processing unit (CPU) 241, a read-only memory (ROM) 242, a random access memory (RAM) 243, and an input and output (I/O) port 244.

The CPU 241 executes a program stored in the ROM 242 to sequentially execute processing such as branching and iterative processing. The ROM 242 is a nonvolatile storage device and stores, for example, the program executed by the CPU 241. The RAM 243 is a memory that functions as a work area which the CPU 241 uses to execute the processing.

A bus line 245 is, for example, an address bus or a data bus for electrically connecting components such as the CPU 241. The I/O port 244 is an interface to which an output signal of a rotary encoder is input and outputs a control signal for controlling a motor 40 (see FIG. 2B) via a motor driver. The controller 90 may not have such a configuration as described above.

Figure 2B:
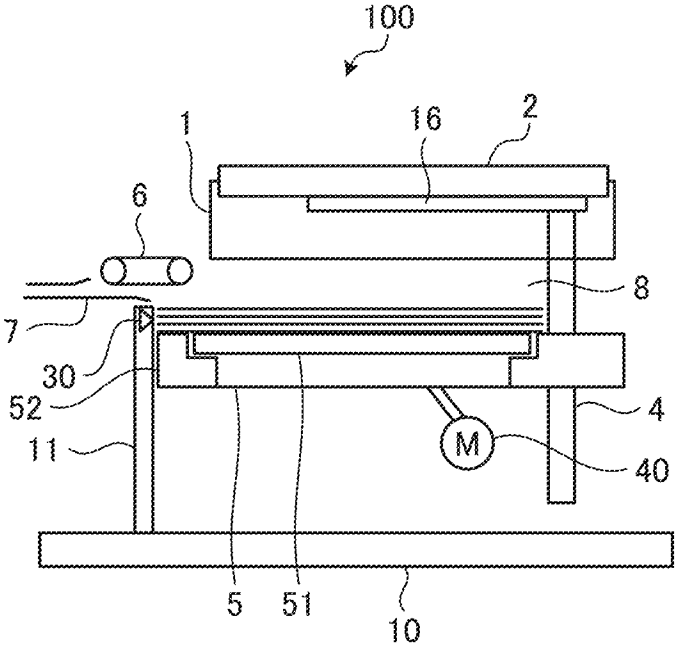
FIGS. 2A and 2B are diagrams each illustrating a sheet tray included in a sheet feeder of an image forming system viewed from a longitudinal direction of sheets, according to an embodiment of the present disclosure.
Figure 2A:
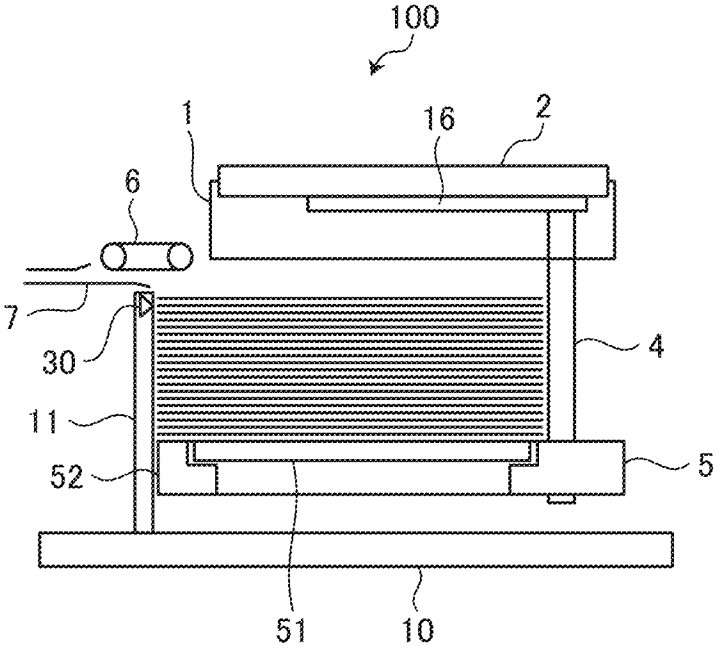

FIGS. 2A and 2B are diagrams each illustrating a sheet tray 100 included in the sheet feeder 210 of the image forming system 200 viewed from a longitudinal direction of the recording media 8, according to an embodiment of the present disclosure.

The sheet tray 100 that is included in the sheet feeder 210 includes a lift table 5 movable in a vertical direction by the motor 40, and has a structure in which recording media 8, such as sheets of paper, are stacked on the lift table 5. The lift table 5 includes bottom supports 51 to support the bottom of the recording media 8 and a front-end bottom support 52 to support the bottom of the front end of the recording media 8 in a conveyance direction of the recording media 8. The lift table 5 is moved in the vertical direction by the motor 40 and is controlled by a sensor such that the upper surface of an uppermost recording medium 8 is positioned at a predetermined position.

The recording media 8 are stacked such that the ends of the recording media 8 downstream in the longitudinal direction of the recording media 8 contact a front-side plate 11. The ends of the recording media 8 upstream in the longitudinal direction are pressed against the end fence 4 to be set. The end fence 4 is coupled to a guide rail 16, and the guide rail 16 is fixed to a guide frame 2. The end fence 4 is movable in the longitudinal direction of the recording media 8 and is fixed with the upstream ends of the recording media 8 in the longitudinal direction of the recording media 8 pressed against the front-side plate 11. The moving amount of the end fence 4 corresponds to the sheet size of the sheets, i.e., the size of the recording media 8, stacked on the sheet tray 100. Thus, a moving range of the end fence 4 is set.

When the printing operation is started, the air is blown out from an air nozzle 30 attached to the front-side plate 11 to float a recording medium 8. Accordingly, the end of the recording medium 8 upstream in the conveyance direction is blown up to the vicinity of a pickup belt 6. Multiple holes are formed in the pickup belt 6, and air is sucked into the multiple holes by a fan. Accordingly, the recording medium 8 floated by the air blown out from the air nozzle 30 is sucked by the pickup belt 6 and is discharged in the direction of the guide plate 7 with the movement of the pickup belt 6. When the recording medium 8, which floats from downstream to upstream in the conveyance direction of the recording medium 8 by the air blown from the air nozzle 30, is excessively floated by the air, the recording medium 8 may be folded and wrinkled. For this reason, multiple sheet-pressing guides 1 are attached to the guide frame 2 in the longitudinal direction of the recording medium 8.

Figure 3B:
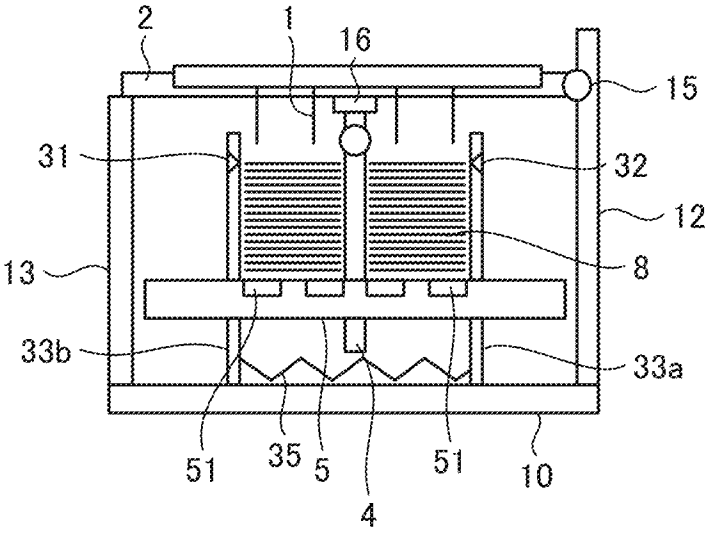
FIG. 3A and FIG. 3B are diagrams each illustrating the sheet tray of FIGS. 2A and 2B included in the sheet feeder of the image forming system, viewed from the lateral direction of sheets, according to an embodiment of the present disclosure.
Figure 3A:
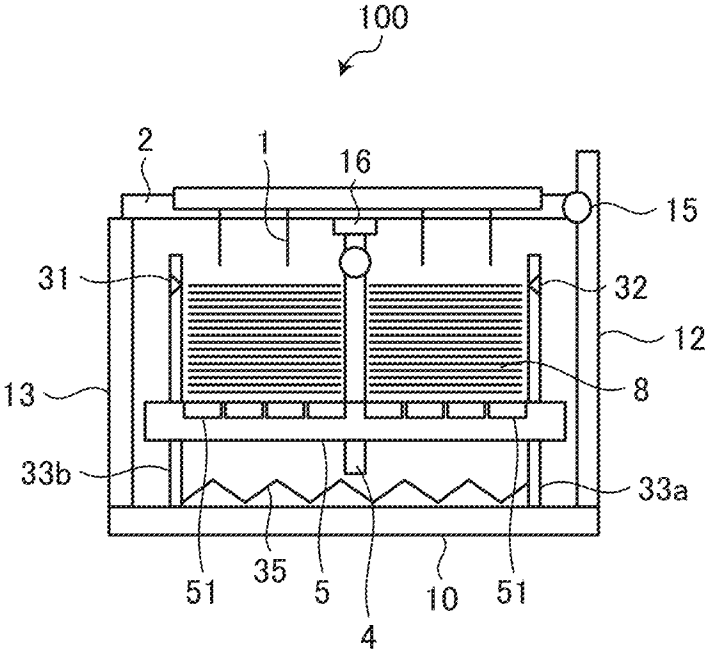

FIGS. 3A and 3B are diagrams each illustrating the sheet tray 100 included in the sheet feeder 210 of the image forming system 200 viewed from the lateral direction of the recording media 8, according to an embodiment of the present disclosure. The sheet tray 100 has a structure in which the lift table 5 and the end fence 4 illustrated in FIGS. 2A and 2B are disposed in a box-shaped structure formed by a left-side plate 13 and a right-side plate 12 attached to a bottom plate 10. The guide frame 2 is attached to the right-side plate 12 via hinges 15 to rotate about the hinges 15. The multiple sheet-pressing guides 1 are attached to the guide frame 2 and are fixed at given positions in accordance with the width of the recording media 8.

A right-side fence 33*a* and a left-side fence 33*b* are attached to the right side and left side, respectively, of the lift table 5. The positions of the right-side fence 33*a* and the left-side fence 33*b* are moved in accordance with the recording media 8 set on the lift table 5. The side fence 33 includes the left-side fence 33*a* and the right-side fence 33*b*, and the left-side fence 33*a* and the right-side fence 33*b* are moved in conjunction with each other by a coupler 35. The multiple bottom supports 51 placed on the lift table 5 are removably attached in accordance with the width of recording media 8 on the lift table 5 and slidable in the width direction of the recording media 8. Multiple air nozzles 31 and 32 are disposed on the left-side fence 33*b* and the right-side fence 33*a*, respectively, and the air is blown from the air nozzles 31 and 32 when the printing operation is started. Accordingly, in the printing operation, several upper sheets of the recording media 8 may float as a whole, and the floated sheets of the recording media 8 are restricted by the sheet-pressing guides 1 and held at a constant height.

Figure 4:
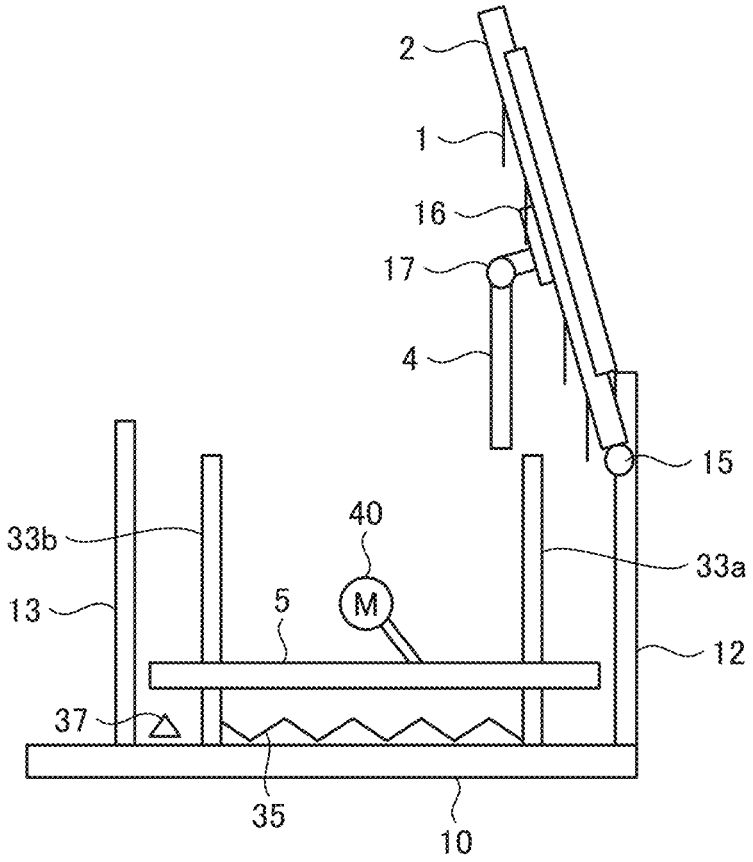
FIG. 4 is a diagram illustrating how a guide frame and an end fence are moved when sheets are set in an image forming apparatus, according to an embodiment of the present disclosure.

FIG. 4 is a diagram illustrating how the guide frame 2 and the end fence 4 are moved when recording media 8 are set in the image forming system 200, which serves as an image forming apparatus, according to an embodiment of the present embodiment.

The lift table 5 is lowered by the motor 40, and the position of the lift table 5 is detected by a position sensor 37 and the lift table 5 is stopped. While the lift table 5 is stopped, the sheet tray 100 is pulled out from the sheet feeder 210, and one end of the guide frame 2 is rotated about the hinges 15 such that the guide frame 2 is lifted. At this time, the guide rail 16 that is fixed to the guide frame 2 is also lifted up in conjunction with the guide frame 2. However, the end fence 4 coupled to the guide rail 16 via a rotary hinge 17 is moved in the vertical direction such that the end fence 4 does not become an obstacle when the recording media 8 are set on the lift table 5. In other words, the end fence 4 can be disposed at a position at which the end fence 4 is installed in the sheet feeder 210 and a position at which the end fence 4 is retracted from the sheet feeder 210. In the present embodiment, the end fence 4 is an example of an end fence movable to a position corresponding to the sheet size of the recording media 8 in the conveyance direction.

The hinge 15 has a structure in which torque is applied only in a direction in which the guide frame 2 falls. When the recording media 8 are set on the lift table 5, the guide frame 2 does not fall even in a state in which a hand of an operator is released from the guide frame 2. The ends of the multiple sheet-pressing guides 1 attached to the guide frame 2 are rotatable at positions at which the sheet-pressing guides 1 are attached to the guide frame 2. Accordingly, the posture of the sheet-pressing guides 1 changes in the vertical direction similar to the end fence 4. However, the sheet-pressing guides 1 are not displaced from the given positions at which the sheet-pressing guides 1 are attached to the guide frame 2. Such a configuration as described above allows the guide frame 2 and the end fence 4 not to become obstacles when the recording media 8 is supplied by an operator.

Figure 5:
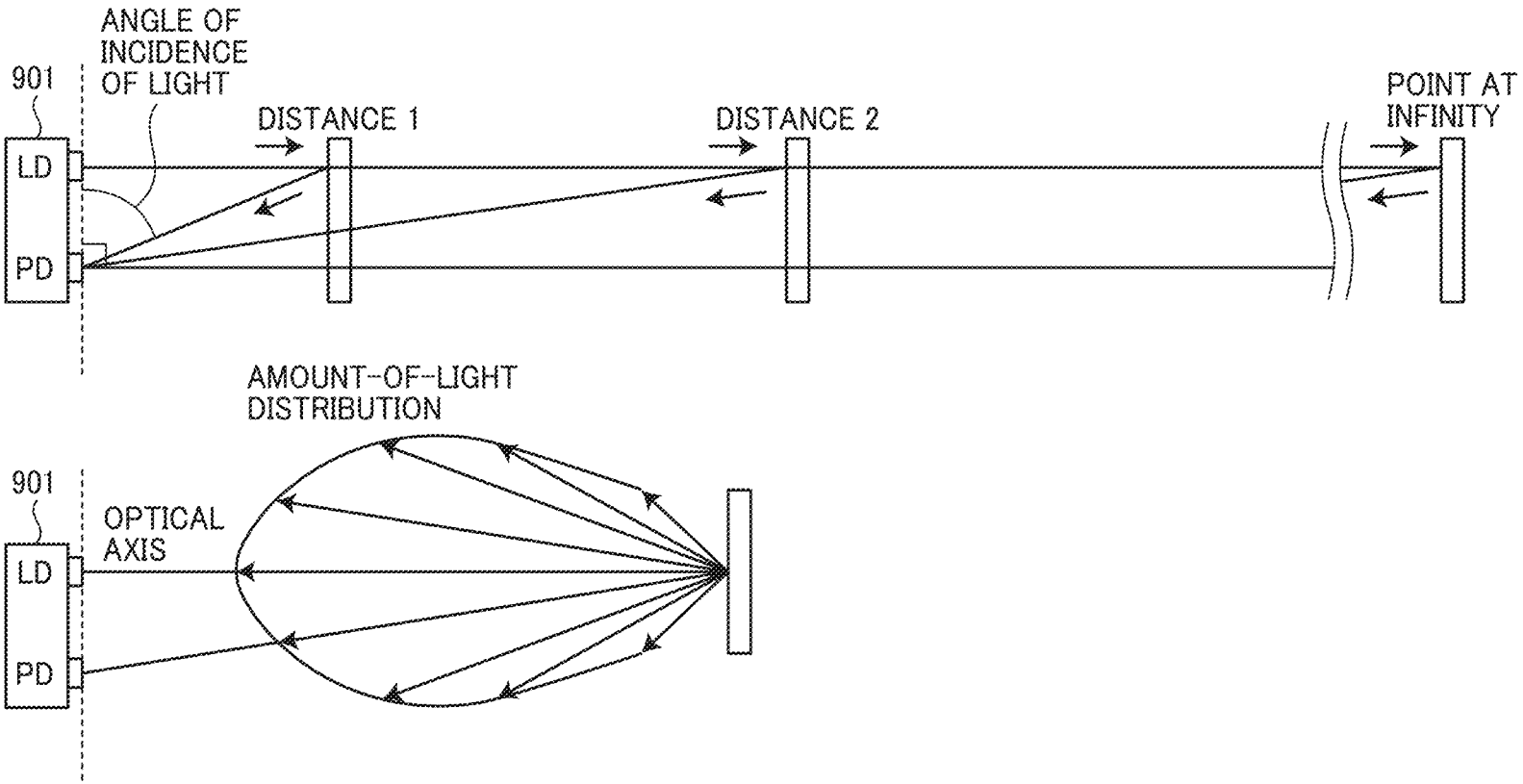
FIG. 5 is a diagram illustrating a principle in which a distance-measuring sensor included in the image forming system of FIG. 1A is operated, according to an embodiment of the present disclosure.

FIG. 5 is a diagram illustrating a principle in which a distance-measuring sensor 901 included in the image forming system 200 is operated, according to an embodiment of the present disclosure.

The distance-measuring sensor 901 is a sensor that detects the distance using diffusion light. The distance-measuring sensor 901 reflects the light emitted from a light emitter LD on an object to be detected, i.e., a reflection surface of the object to be detected, and outputs a sensor-output value V-out in accordance with a position at which the diffusion light enters a light receiver PD, i.e., an angle at which the diffusion light enters the light receiver PD and the light amount is a peak in the diffusion light entering the light receiver PD. Accordingly, the sensor-output value V-out can be converted into a distance from the distance-measuring sensor 901 to the object to be detected. Specifically, the distance-measuring sensor 901 detects that the distance from the distance-measuring sensor 901 to the object to be detected is short and that the sensor output value V-out is large, when the diffusion light obliquely enters the light receiver PD. The distance-measuring sensor 901 detects that the distance from the distance-measuring sensor 901 to the object to be detected is large and that the sensor-output value V-out is large, when the diffusion light straightly enters the light receiver PD. Typically, the amount of diffusion light reflected from the reflection surface of the object to be detected on the optical axis is large. Accordingly, the distance-measuring sensor 901 can correctly detect the distance to the object to be detected.

Figure 6:
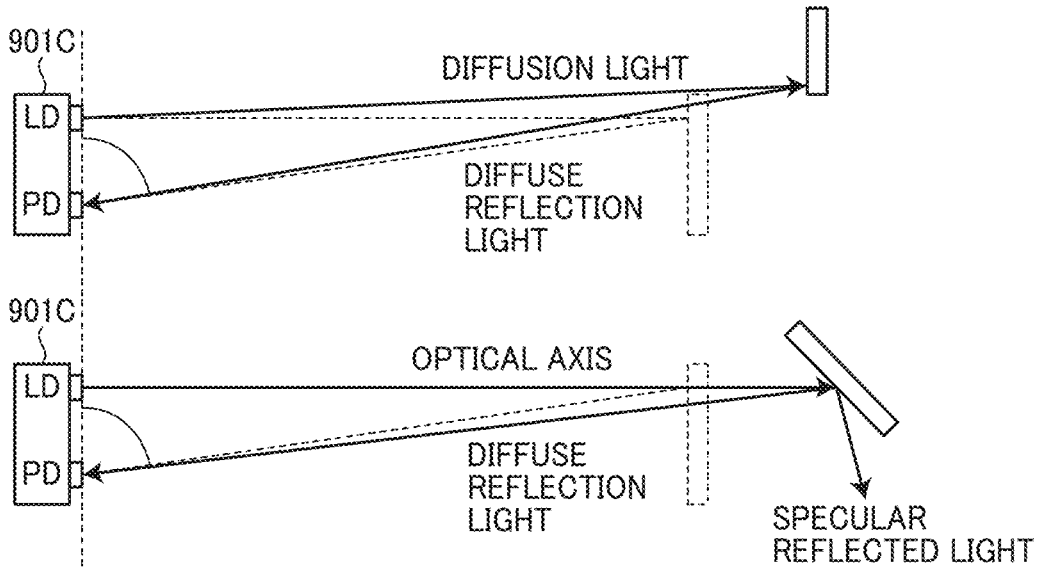
FIG. 6 is a diagram illustrating a principle in which a distance-measuring sensor according to a comparative example is operated.

FIG. 6 is a diagram illustrating a principle in which a distance-measuring sensor 901C according to a comparative example is operated.

The position at which the diffusion light enters a light receiver PD of the distance-measuring sensor 901C is a relative position at which the light amount of the diffusion light reaches a peak. For this reason, the position at which the diffusion light enters the light receiver PD does not change even if the reflectance of the reflection surface of the object to be detected is lowered. Accordingly, even when the reflective surface of the object to be detected does not directly face a light emitter LD of the distance-measuring sensor 901C, the light emitted from the light emitter LD is diffusion light. Accordingly, the light enters the light receiver PD. Even when the light emitted from the light emitter LD is reflected by an oblique surface of the object to be detected, the diffusion light of the light reflected by the oblique surface of the object to be detected is received by the light receiver PD even if the amount of light entering the light receiver PD is reduced. If the difference in distance from the reflection surface of the object to be detected when there is an object to be detected to the reflection surface of the object to be detected when there is no object to be detected can be secured, there is an ample amount of difference in distance. Accordingly, detection can be performed based on the output difference of the light receiver PD. However, in many cases in which the size of apparatuses is restricted, the above-described difference in distance may not be secured. When a distance-measuring sensor having a wide range is employed, the variations of the output of the light receiver are large. For this reason, securing the difference in distance is even more difficult.

Figure 7:
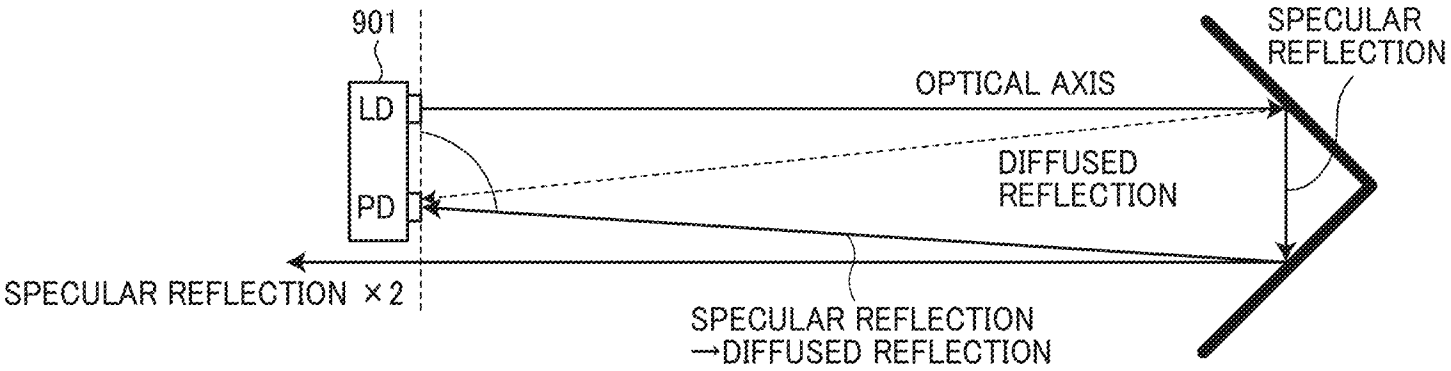
FIG. 7 is a diagram illustrating a principle in which a distance-measuring sensor included in the image forming system of FIG. 1A detects a distance, according to an embodiment of the present disclosure.
Figure 8B:
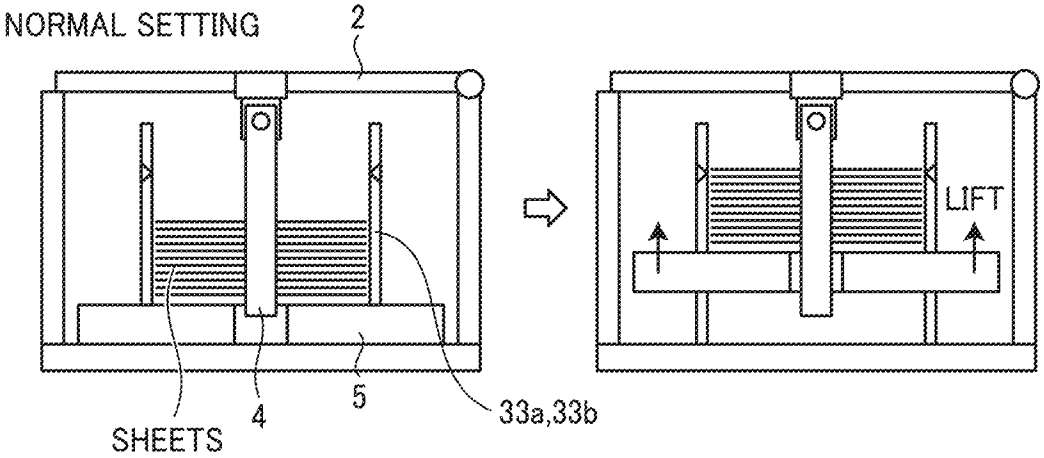
FIGS. 8A, 8B, and 8C are diagrams each illustrating processing to detect when an end fence is not correctly set in the image forming system, according to an embodiment of the present disclosure.
Figure 8C:
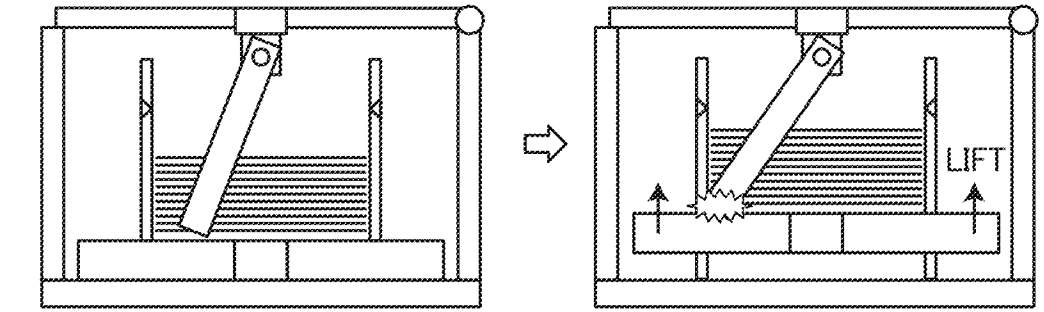
Figure 8A:
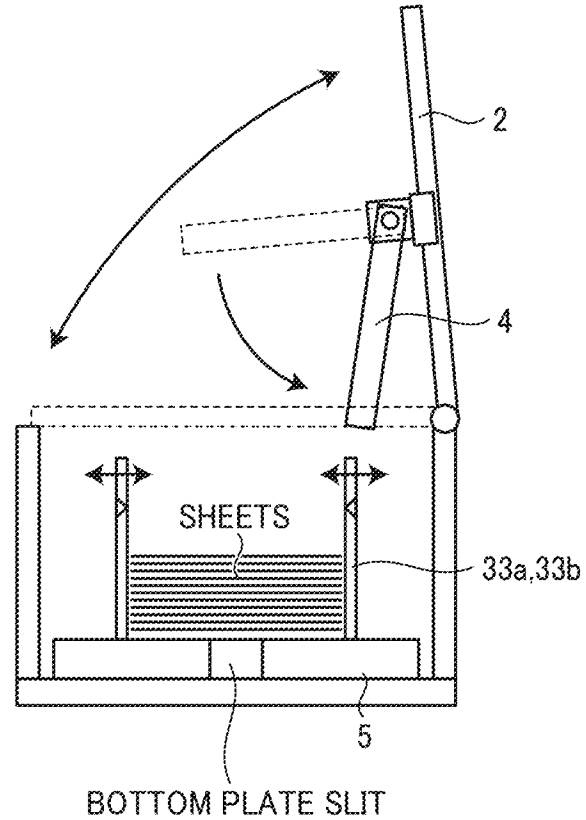
Figure 9A:
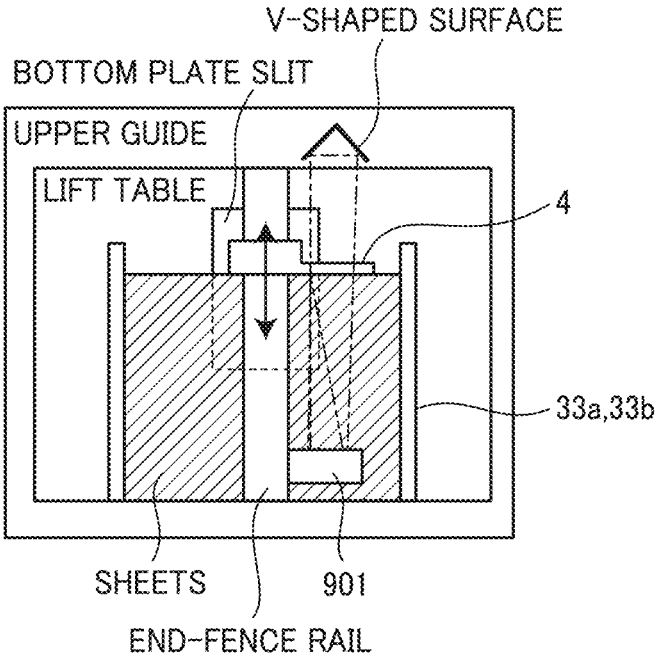
FIGS. 9A and 9B are diagrams each illustrating processing to detect when an end fence is not correctly set in the image forming system, according to an embodiment of the present disclosure.
Figure 9B:
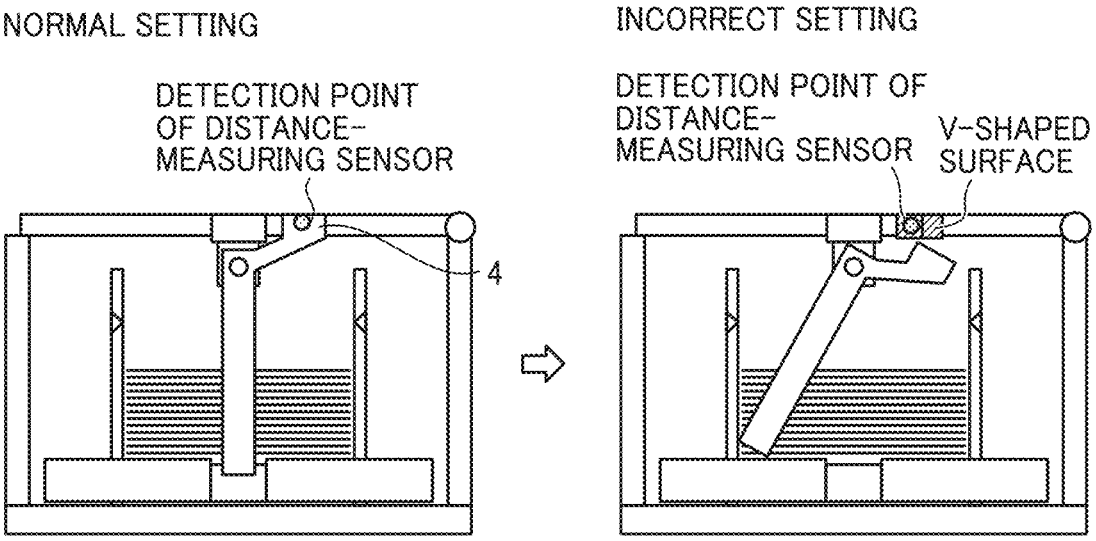

FIG. 7 is a diagram illustrating a principle in which the distance-measuring sensor 901 included in the image forming system 200 detects the distance to an object to be detected, according to an embodiment of the present disclosure.

The image forming system 200 according to the present embodiment can cause the distance-measuring sensor 901 to reliably detect the distance to the reflection surface of the object to be detected without being affected by the above-described disadvantage, as in a case in which the distance to the object to be detected is long, even when the distance to the reflection surface of the object to be detected is short. Accordingly, the image forming system 200 can detect the presence or absence of an object to be detected. The image forming system 200 can also reliably detect the distance to the object to be detected when the object to be detected is present.

Specifically, when an object to be detected is absent, two faces that form an angle with respect to the optical axis of the light emitter LD, for example, two faces that form a V-shaped surface of approximately 90 degrees, are disposed as an object to be detected facing the light emitter LD. Accordingly, the amount of light received by the light receiver PD is larger in twice reflected light, which is diffusion light from reflected light, than in once reflected light, which is diffusion light. Thus, the distance-measuring sensor 901 can detect the position at which the twice reflected light enters the light receiver PD. In other words, the reflected light enters the light receiver PD at the right angle with respect to the surface of the light receiver PD or at a slightly oblique angle with respect to the right angle. Accordingly, the distance-measuring sensor 901 can detect via the light receiver PD that the object to be detected is disposed at a point at infinity, i.e., a point at which the sensor output value V-out is a minimum value.

Preferably, the angle formed by the two faces that reflect the light from the light emitter LD is, preferably, approximately 45 degrees with respect to the optical axis of the light emitted from the light emitter LD, and the angle formed by the two faces is approximately 90 degrees. The two faces may or may not include a clearance between the two faces. With respect to the amount of light that enters the light receiver PD, preferably the amount of the twice reflected light is greater than the amount of the once reflected light. For this reason, preferably, the two faces have a certain degree of glossiness. For example, the glossiness is preferably equal to or greater than the glossiness of 25°. Even more preferably, the glossiness is equivalent to the glossiness of 60°.

FIGS. 8A, 8B, 8C, 9A, and 9B are diagrams each illustrating processing to detect whether the end fence 4 is correctly set in the image forming system 200, according to an embodiment of the present disclosure. When recording media 8 are set in the sheet tray 100, the guide frame 2 as an upper guide and the end fence 4 are rotated to facilitate access to the recording media 8. However, if the lift table 5 is lifted with the end fence 4 not being fully lowered, the end fence 4 may be caught between the bottom plate 10 and the side fence 33*a* or 33*b*, and may be damaged.

When the end fence 4 is correctly set with the lift table 5, a distal end of the end fence 4 enters a slit of the lift table 5. Accordingly, the distance-measuring sensor 901 can detect the distance from the distance-measuring sensor 901 to the plane detection surface on the end fence 4. In the present embodiment, the plane detection surface on the end fence 4 functions as an example of a first detection surface perpendicular to the optical axis of the distance-measuring sensor 901. For this reason, the distance-measuring sensor 901 is disposed to face one surface, i.e., a front surface, of the plane detection surface of the end fence 4.

When the end fence 4 is not correctly set with the lift table 5, the distal end of the end fence 4 does not enter the slit of the lift table 5. Accordingly, the end fence 4 rotates with the distal end of the end fence 4 being placed on the bottom plate 10. As a result, the plane detection surface of the end fence 4 is located at a position retracted from the distance-measuring sensor 901. In other words, when the end fence 4 rotates, the plane detection surface of the end fence 4 or a V-shaped surface to be described below can be retracted from the distance-measuring sensor 901. In this case, the distance-measuring sensor 901 detects the V-shaped surface behind the plane detection surface of the end fence 4. By so doing, the distance-measuring sensor 901 detects a point at infinity and obtains a detection result indicating that the plane detection surface of the end fence 4 is absent. In other words, when the distance-measuring sensor 901 detects the V-shaped surface, the distance-measuring sensor 901 detects the V-shaped surface as an object disposed at a long distance, for example, as an object disposed at the point at infinity. The V-shaped surface functions as an example of a second detection surface disposed behind or in front of the plane detection surface of the end fence 4 with respect to the distance-measuring sensor 901. In other words, the V-shaped surface is disposed to face the rear surface of the plane detection surface of the end fence 4. The V-shaped surface includes two faces inclined with respect to the optical axis of the distance-measuring sensor 901.

The distance-measuring sensor 901 includes the light emitter LD and the light receiver PD. When the distance-measuring sensor 901 detects the V-shaped surface, in the amount of light that enters the light receiver PD, the diffuse reflected light that is specularly reflected from one face of the two faces of the V-shaped surface and reflected from the other face of the two faces of the V-shaped surface is greater than the diffuse reflected light that is directly reflected from the one face of the V-shaped surface. In the following description, the one face of the V-shaped surface may also be referred to as a first face, and the other face may also be referred to as a second face. Since the amount of diffuse reflected light from the two faces of the V-shaped surface is large, the light enters the light receiver PD of the distance-measuring sensor 901 from a pseudo long distance. Accordingly, the V-shaped surface can be detected as an object disposed at a long distance.

The angle formed by the two faces of the V-shaped surface is preferably in the vicinity of 90 degrees. Owing to such a configuration as described above, theoretically, the amount of the diffuse reflected light from the two faces of the V-shaped surface can be maximized. Accordingly, the detection accuracy of the distance-measuring sensor 901 when the distance-measuring sensor 901 detects the V-shaped surface can be enhanced. For example, the glossiness of at least one of the two faces of the V-shaped surface is preferably equal to or greater than the glossiness of 25°. Even more preferably, the glossiness is equivalent to the glossiness of 60°. Accordingly, a certain degree of glossiness on the V-shaped surface can be secured. The diffuse reflected light that is specularly reflected from the first face of the V-shaped surface and reflected from the second face of the V-shaped surface is greater than the diffuse reflected light that is directly reflected from the first face of the V-shaped surface. As a result, the detection accuracy of the distance-measuring sensor 901 can be enhanced when the distance-measuring sensor 901 detects the V-shaped surface.

The controller 90 can cause the distance-measuring sensor 901 to determine whether the plane detection surface of the end fence 4 is detected or the V-shaped surface is detected. In other words, the sensor output value V-out of the distance-measuring sensor 901 changes depending on whether the plane detection surface of the end fence 4 is retracted from the distance-measuring sensor 901. Accordingly, the controller 90 can determine whether the distance-measuring sensor 901 detects the plane detection surface of the end fence 4 or the V-shaped surface based on the sensor output value V-out of the distance-measuring sensor 901. In other words, when the end fence 4 is installed in the sheet feeder 210, the controller 90 causes the distance-measuring sensor 901 to detect the distance to the plane detection surface of the end fence 4, and the controller 90 detects the sheet size of the recording medium 8 based on the detected distance to the plane detection surface of the end fence 4. In other words, the controller 90 can detect the distance from the distance-measuring sensor 901 to the plane detection surface of the end fence 4 in response to the detection of the plane detection surface of the end fence 4. On the other hand, the controller 90 detects the V-shaped surface when the end fence 4 is retracted from the distance-measuring sensor 901. Accordingly, the controller 90 determines whether the end fence 4 is installed in the sheet feeder 210 or retracted from the sheet feeder 210.

As a result, the controller 90 can determine whether the end fence 4 is correctly set with the lift table 5 and prevents the lift table 5 from being lifted when the end fence 4 is not correctly set with the lift table 5. By so doing, the end fence 4 can be prevented from being damaged. The single distance-measuring sensor 901 can determine whether the end fence 4 is correctly set with the lift table 5 and the sheet size of the recording medium 8. Accordingly, the configuration of the sheet feeder 210 is also simple and the cost of the sheet feeder 210 is also advantageous. As described above, the distance-measuring sensor 901 can be employed both to determine whether the end fence 4, which contacts the rear ends of the recording media 8 in the sheet conveyance direction, is correctly set with the lift table 5 and to detect the sheet size of the recording media 8, in the sheet feeder 210 on which the large capacity sheet feeding lift table 5 is mounted. In the present embodiment, the distance-measuring sensor 901, the end fence 4, the V-shaped surface, and the controller 90 collectively function as a distance detector.

When the distance-measuring sensor 901 detects the V-shaped surface, the distance-measuring sensor 901 detects the V-shaped surface as an object disposed at a long distance. As described above, depending on the angle at which the reflected light enters the light receiver PD of the distance-measuring sensor 901, the distance-measuring sensor 901 detects a detection target as an object disposed at a long distance. Accordingly, the distance-measuring sensor 901 can detect whether the detection target is present or absent.

Figure 10A:
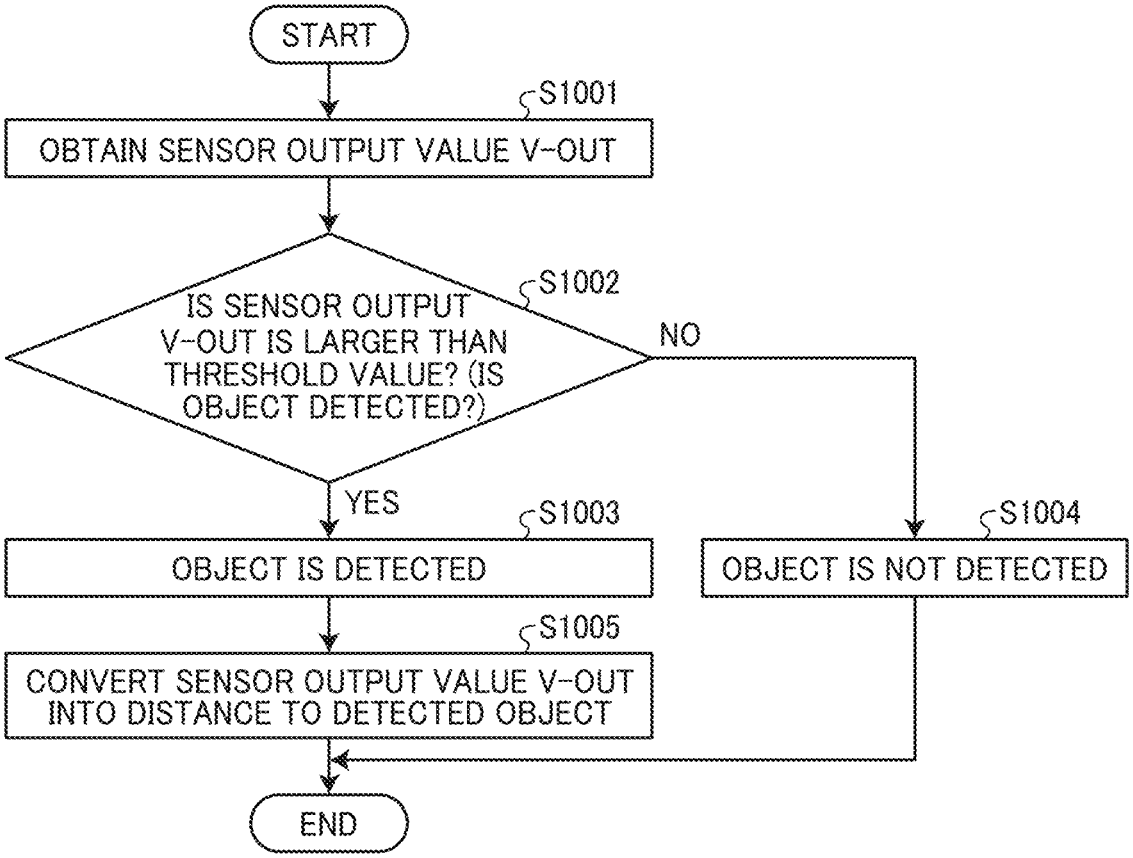
FIG. 10A is a flowchart of a process in which a distance-measuring sensor of the image forming system of FIG. 1A determines a distance from the distance-measuring sensor to a detection target, according to an embodiment of the present disclosure.

FIG. 10A is a flowchart of a process in which the distance-measuring sensor 901 of the image forming system 200 determines a distance from the distance-measuring sensor 901 to a detection target, according to an embodiment of the present disclosure.

First, in step S1001, the controller 90 acquires a V-out which is a sensor output value of the distance-measuring sensor 901. Subsequently, in step S1002, the controller 90 determines the presence or absence of an object to be detected based on the sensor output value V-out.

If the sensor output value V-out is greater than a threshold (YES in S1002), in step S1003, the controller 90 determines that there is an object to be detected. Then, in step S1005, the controller 90 converts the sensor-output value V-out into a distance from the distance-measuring sensor 901 to the object to be detected. Alternatively, when the sensor output value V-out is equal to or smaller than the threshold (NO in step S1002), in step S1004, the controller 90 determines that there is no object to be detected.

Figure 10B:
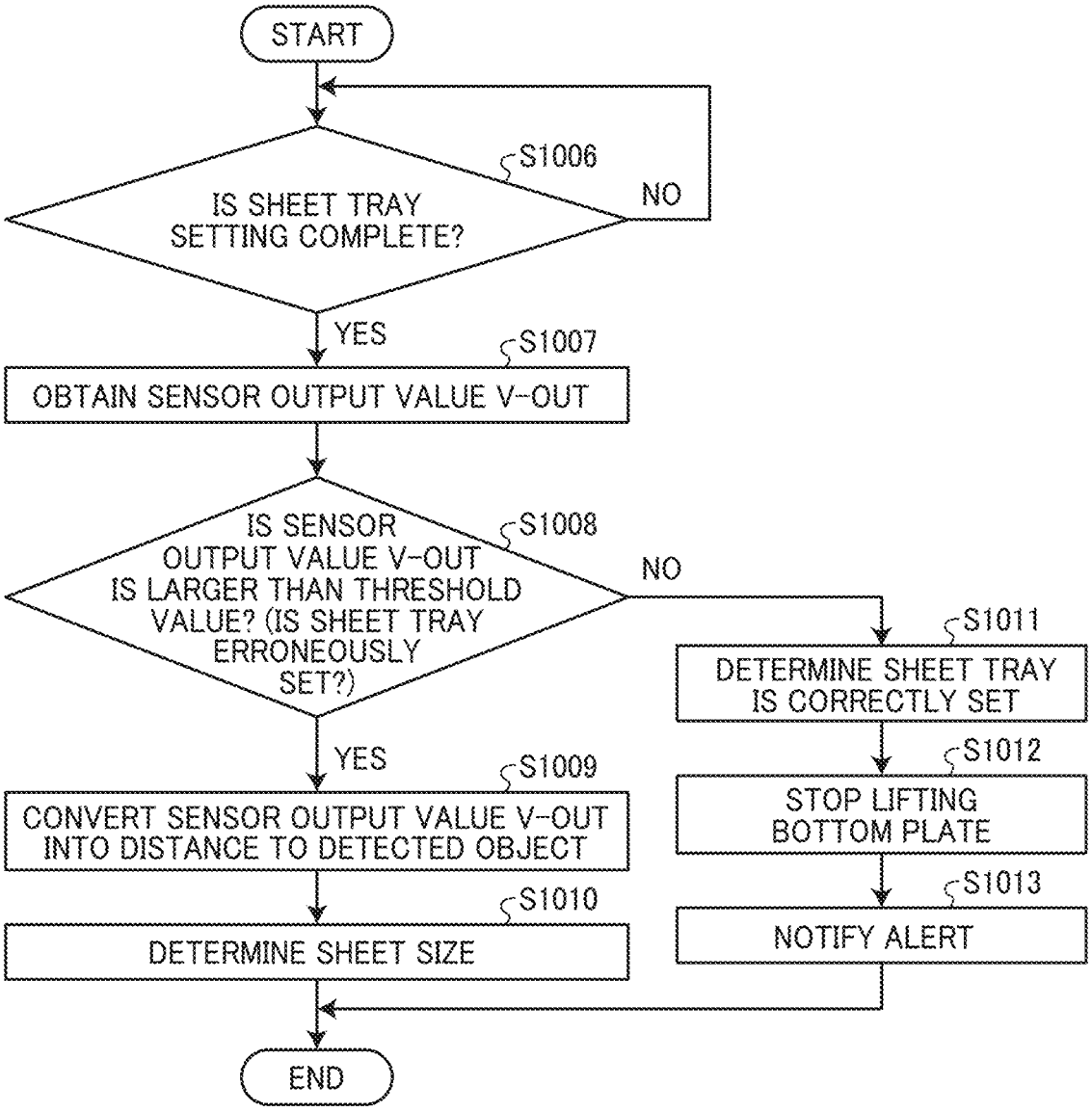
FIG. 10B is a flowchart of a process to detect when an end fence is not correctly set and the sheet size of sheets in the image forming apparatus, according to an embodiment of the present disclosure.

FIG. 10B is a flowchart of a process to detect whether the end fence 4 is correctly set with the lift table 5 and the sheet size of the recording media 8 in the image forming system 200, which serves as an image forming apparatus, according to the present embodiment.

First, in step S1006, the controller 90 determines whether a setting operation of the sheet tray 100 is completed. When the setting operation of the sheet tray 100 is completed (YES in step S1006), in step S1007, the controller 90 acquires the sensor output value V-out of the distance-measuring sensor 901.

Subsequently, in step S1008, the controller 90 determines whether the sheet tray 100 is correctly set with the lift table 5. When the sensor-output value V-out is greater than the threshold (YES in step S1008), in step S1009, the controller 90 determines that the sheet tray 100 is correctly set with the lift table 5 and converts the sensor-output value V-out into a distance from the distance-measuring sensor 901 to the object to be detected. Further, in step S1010, the controller 90 determines the sheet size of the recording media 8 set in the sheet tray 100 based on the distance from the distance-measuring sensor 901 to the object to be detected.

Alternatively, when the sensor-output value V-out is equal to or smaller than the threshold (NO in step S1008), in step 1011, the controller 90 determines that the sheet tray 100 is not correctly set with the lift table 5 (step S1011), and then, in step S1002, stops lifting the bottom plate 10. Then, in step S1013, the controller 90 performs an error notification.

As described above, the distance-measuring sensor 901 can be employed both to determine whether the end fence 4, which contacts the rear ends of the recording media 8 in the sheet conveyance direction, is correctly set with the lift table 5 and to detect the sheet size of the recording media 8, in the sheet feeder 210 on which the large capacity sheet feeding lift table 5 is mounted. When the end fence 4 is correctly set with the lift table 5, the distal end of the end fence 4 enters the slit of the lift table 5. Accordingly, the distance-measuring sensor 901 can detect the distance to the plane detection surface of the end fence 4. Alternatively, when the end fence 4 is not correctly set with the lift table 5, the distal end of the end fence 4 does not enter the slit of the lift table 5. Accordingly, the end fence 4 rotates with the distal end of the end fence 4 being placed on the bottom plate 10. As a result, the plane detection surface of the end fence 4 is located at a position retracted from the distance-measuring sensor 901.

At this time, the distance-measuring sensor 901 detects the V-shaped surface behind the plane detection surface of the end fence 4. Accordingly, the detection result indicates that the distance-measuring sensor 901 detects a point at infinity and a detection target is absent. From this detection result, the controller 90 determines that the end fence 4 is not correctly set with the lift table 5 and prevents the lift table 5 from being lifted with the end fence 4 being not correctly set. Thus, the end fence 4 can be prevented from being damaged. The above-described effects can be achieved by the single distance-measuring sensor 901. Accordingly, the configuration of the sheet feeder 210 is simple and the cost of the sheet feeder 210 is also advantageous.

Figure 11:
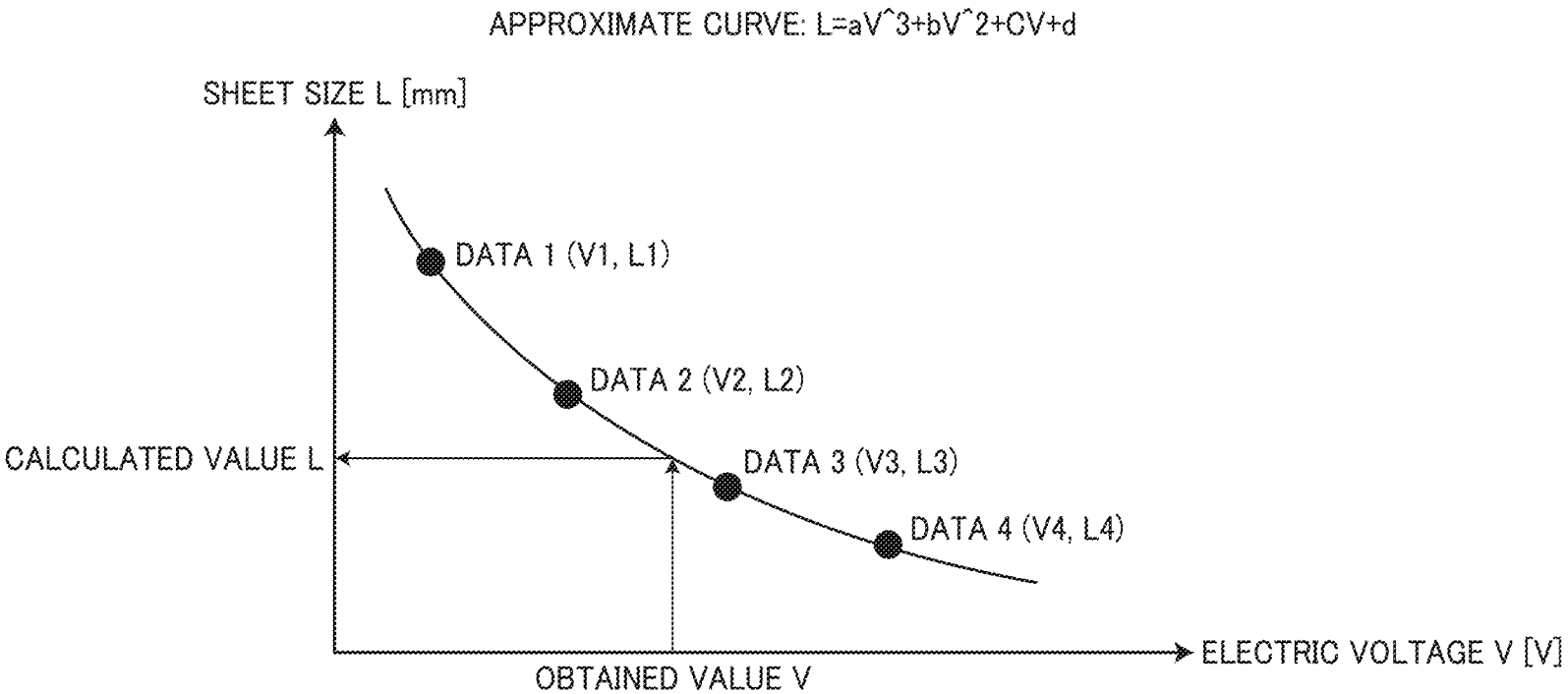
FIG. 11 is a graph illustrating a method in which the distance-measuring sensor of the image forming system of FIG. 1A is adjusted, according to an embodiment of the present disclosure.

FIG. 11 is a graph illustrating a method in which the distance-measuring sensor 901 of the image forming system 200 is adjusted, according to an embodiment of the present disclosure.

In FIG. 11, the horizontal axis represents the sensor output value V-out of the distance-measuring sensor 901 and the vertical axis represents the position of the end fence 4, i.e., a calculated value L of the sheet size of the recording media 8.

The distance-measuring sensor 901 may include components having a large variation. For this reason, desirably, calibration of the distance-measuring sensor 901 is performed in advance before the distance-measuring sensor 901 is operated. Specifically, the controller 90 functions as an example of an adjusting unit that obtains a conversion formula of the sensor output value V-out of the distance-measuring sensor 901 and the distance to the end fence 4 in advance before the distance-measuring sensor 901 is operated. In the calibration step of the distance-measuring sensor 901, the controller 90 acquires the sensor output values V-out and the distances to the end fence 4 at multiple points on the end fence 4. Subsequently, the controller 90 calculates an approximation formula, i.e., an approximate curve, that represents the relation between the sensor output values V-out and the distances to the end fence 4. In the present embodiment, the approximate line may be an approximate curve of all the multiple points or may be an approximation straight line between the multiple points.

When the end fence 4 is installed in the sheet feeder 210, the controller 90 uses the approximation formula to convert the sensor output value V-out when the distance-measuring sensor 901 detects the plane detection surface of the end fence 4 into a distance to the end fence 4 and detects the sheet size of the recording media 8 based on the distance. Such a configuration as described above allows the controller 90 to accurately convert the sensor output value V-out of the distance-measuring sensor 901 into the distance to the end fence 4 even when the distance-measuring sensor 901 has a large variation.

Subsequently, when the recording media 8 are set in the sheet tray 100, the controller 90 acquires the sensor output value V-out of the distance-measuring sensor 901. When the sensor output value V-out is equal to or smaller than the threshold, the distance-measuring sensor 901 detects that the end fence 4 is not correctly set with the lift table 5. When the sensor output value V-out is larger than the threshold, the controller 90 converts the sensor output value V-out into a distance based on the approximation formula and determines the sheet size of the recording media 8 to automatically set the sheet size of the recording media 8. Alternatively, when the determined sheet size of the recording media 8 is different from the sheet size manually set by a user, the controller 90 may notify the user that the sheet size manually set does not match with the sheet size determined by the controller 90.

As described above, in the image forming system 200 according to embodiments of the present embodiment, whether the end fence 4 is correctly set with the lift table 5 can be determined and the lift table 5 can be prevented from being lifted while the end fence 4 is not correctly set. Accordingly, the end fence 4 can be prevented from being damaged. The single distance-measuring sensor 901 can determine whether the end fence 4 is correctly set with the lift table 5 and the sheet size of the recording medium 8. Accordingly, the configuration of the sheet feeder 210 is also simple and the cost of the sheet feeder 210 is also advantageous.

Each function executed by the controller 90 according to the embodiments described above can be achieved by one or multiple processing circuits. The processing circuit according to embodiments of the present disclosure includes a processor programmed to execute functions by software such as a central processing unit (CPU) implemented by an electronic circuit, and a device such as an application-specific integrated circuit (ASIC), a digital signal processor (DSP), a field programmable gate array (FPGA), or a known circuit module designed to execute each of the functions described above.

In the above-described embodiments of the present disclosure, the image forming apparatus has been described as a multifunction peripheral (MFP) that includes the functionality of the copying machine, the printer, and the facsimile machine having at least two functions of a copy function, a printer function, a scanner function, and a facsimile function. However, an image forming apparatus according to embodiments of the present disclosure is not limited to such a multifunction peripheral and may be any image forming apparatus such as a copy machine, a printer, a scanner, or a facsimile machine.

Aspects of the present disclosure are, for example, as follows.

First Aspect

A distance detector includes a distance-measuring sensor, a first detection surface, a second detection surface, and a controller. The first detection surface is perpendicular to an optical axis of the distance-measuring sensor. The second detection surface is behind or in front of the first detection surface with respect to the distance-measuring sensor. The second detection surface has two faces inclined with respect to the optical axis of the distance-measuring sensor. The first detection surface or the second detection surface is retractable from the distance-measuring sensor. The controller can determine whether the first detection surface or the second detection surface is detected by the distance-measuring sensor. The controller can cause the distance detector to detect a distance from the distance-measuring sensor to the first detection surface based on detection of the first detection surface by the distance-measuring sensor.

Second Aspect

In the distance detector according to the first aspect, the distance-measuring sensor detects the distance as long distance when the distance-measuring sensor detects second detection surface.

Third Aspect

In the distance detector according to the first aspect or the second aspect, the distance-measuring sensor includes a light emitter and a light receiver. When the distance-measuring sensor detects the second detection surface, the diffuse reflected light that is specularly reflected from one of two faces of the second detection surface and reflected from the other of the two faces of the second detection surface is greater in amount of light entering the light receiver than the diffuse reflected light that is directly reflected from the one of the two faces of the second detection surface.

Fourth Aspect

In the distance detector according to any one of the first to third aspects, an angle formed by the two faces of the second detection surface is in the vicinity of 90 degrees.

Fifth Aspect

In the distance detector according to any one of the first to fourth aspects, a glossiness of at least one of the two faces of the second detection surface is equal to or greater than a glossiness of 25°.

Sixth Aspect

In the distance detector according to the fifth aspect, the glossiness of the at least one of the two faces of the second detection surface is equivalent to a glossiness of 60°.

Seventh Aspect

A sheet feeder includes a lift table, an end fence, a distance-measuring sensor, a surface, and a controller. The end fence is movable to a position corresponding to a size of a recording medium in a conveyance direction of the recording medium. The end fence is switchable between an installed state at which the end fence is installed in the sheet feeder and a retracted state at which the end fence is retracted from the sheet feeder. The distance-measuring sensor is disposed to face a front surface of the end fence. The surface includes two faces to face a rear surface of the end fence. The two faces are inclined with respect to an optical axis of the distance-measuring sensor. The controller causes the distance-measuring sensor to detect a distance from the distance-measuring sensor to the front surface of the end fence to detect a sheet size of the recording medium when the end fence is in the installed state and detect the front surface of the end fence to determine whether the end fence is in the installed state or the retracted state.

Eighth Aspect

The sheet feeder according to the seventh aspect further includes an adjusting unit. The adjusting unit acquires sensor output values of the distance-measuring sensor and distances to the end fence at multiple points on the end fence and calculates an approximation formula that represents a relation between the sensor output values and the distances. The adjusting unit converts the sensor output values acquired when the front surface of the end fence is detected, into a distance to the end fence, using the approximation formula when the end fence is in the installed state.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A distance detector comprising:

a distance-measuring sensor;

a first detection surface perpendicular to an optical axis of the distance-measuring sensor;

a second detection surface behind or in front of the first detection surface with respect to the distance-measuring sensor, the second detection surface having two faces inclined with respect to the optical axis of the distance-measuring sensor, the first detection surface or the second detection surface being retractable from the distance-measuring sensor; and processing circuitry to:

determine whether the first detection surface or the second detection surface is detected by the distance-measuring sensor; and cause the distance detector to detect a distance from the distance-measuring sensor to the first detection surface based on detection of the first detection surface by the distance-measuring sensor.

2. The distance detector according to claim 1, wherein the distance-measuring sensor detects the distance as long distance when the distance-measuring sensor detects the second detection surface.

3. The distance detector according to claim 1, wherein the distance-measuring sensor includes:

a light emitter; and a light receiver, wherein when the distance-measuring sensor detects the second detection surface, diffuse reflected light that is specularly reflected from one of two faces of the second detection surface of the two faces is greater in amount of light entering the light receiver than diffuse reflected light that is directly reflected from the one of the two faces of the second detection surface.

4. The distance detector according to claim 1, wherein an angle formed by the two faces of the second detection surface is in vicinity of 90 degrees.

5. The distance detector according to claim 1, wherein a glossiness of at least one of the two faces of the second detection surface is equal to or greater than a glossiness of 25°.

6. The distance detector according to claim 5, wherein the glossiness of the at least one of the two faces of the second detection surface is equivalent to a glossiness of 60°.

7. A sheet feeder comprising:

a lift table;

an end fence movable to a position corresponding to a size of a recording medium in a conveyance direction of the recording medium, the end fence switchable between an installed state at which the end fence is installed in the sheet feeder and a retracted state at which the end fence is retracted from the sheet feeder;

a distance-measuring sensor to face a front surface of the end fence;

a surface including two faces to face a rear surface of the end fence, the two faces inclined with respect to an optical axis of the distance-measuring sensor; and processing circuitry to cause the distance-measuring sensor to:

detect a distance from the distance-measuring sensor to the front surface of the end fence to detect a sheet size of the recording medium when the end fence is in the installed state; and detect the front surface of the end fence to determine whether the end fence is in the installed state or the retracted state.

8. The sheet feeder according to claim 7, wherein the processing circuitry is configured to:

acquire sensor output values of the distance-measuring sensor and distances to the end fence at multiple points on the end fence and calculate an approximation formula that represents a relation between the sensor output values and the distances; and convert the sensor output values acquired when the front surface of the end fence is detected, into a distance to the end fence, using the approximation formula when the end fence is in the installed state.

9. An image forming apparatus comprising the sheet feeder according to claim 7.

* * * * *